United States Patent [19]

Takenaka et al.

[11] Patent Number: 4,712,038

[45] Date of Patent: Dec. 8, 1987

[54] COLOR CATHODE RAY TUBE WITH PLURAL ELECTRON GUN ASSEMBLIES

[75] Inventors: Shigeo Takenaka; Eiji Kamohara; Takashi Nishimura, all of Fukaya, Japan

[73] Assignee: Kabushiki Kaisha Toshiba, Kawasaki, Japan

[21] Appl. No.: 861,842

[22] Filed: May 12, 1986

[30] Foreign Application Priority Data

May 10, 1985 [JP] Japan ..... 60-97902

[51] Int. Cl.[4] ..... H01J 29/07; H01J 29/50; H01J 29/82; H01J 29/86

[52] U.S. Cl. ..... 313/2.1; 313/402; 313/477 R; 220/2.1 A

[58] Field of Search ..... 313/477 R, 1, 2.1, 402, 313/408; 220/2.1 A, 2.3 A; 358/242

[56] References Cited

U.S. PATENT DOCUMENTS 3,071,706 1/1963 Waldorf ..... 313/2.1 X

FOREIGN PATENT DOCUMENTS 39-25641 9/1964 Japan .
42-4928 2/1967 Japan .
49-26029 7/1974 Japan .
54-12035 5/1979 Japan .

*Primary Examiner*—David K. Moore
*Assistant Examiner*—K. Wieder
*Attorney, Agent, or Firm*—Cushman, Darby & Cushman

[57] ABSTRACT

In a color cathode ray tube, a panel having a single faceplate is coupled to a plurality of necks through a plurality of funnels, respectively. A plurality of electron gun assemblies are received in necks and a plurality of deflection units are mounted around the funnels, respectively. A screen is formed on an inner surface of faceplate and has a plurality of continuous segment regions each of which is scanned with the electron beams emitted from the corresponding electron gun assembly and deflected by the corresponding deflection unit. A shadow mask is so supported in the panel as to face the faceplate. The electron gun assemblies adjacent each other so arranged as to have a relative distance GS between the central axis thereof:

$$GS=m\cdot SG[(n-1)Ph+d]/Ph$$

where SG is a relative distance on the deflection plane, between the electron beams emitted from each of said electron gun assembly, d is a distance between predetermined effective apertures of the shadow mask through which the predetermined electron beams pass, the predetermined electron beams landing on endmost adjacent effective phosphor elements in each two adjacent ones of said segment regions, and m and n are integers, respectively.

7 Claims, 5 Drawing Figures

COLOR CATHODE RAY TUBE WITH PLURAL ELECTRON GUN ASSEMBLIES

BACKGROUND OF THE INVENTION

The present invention relates to a color cathode ray tube and, more particularly, to a color cathode ray tube of a multineck structure, which has a multiple number of necks and electron gun assemblies accommodated in the respective necks, and the screen of which is defined by a plurality of continuous display segment regions, each emitting light upon landing of electron beams from a corresponding one of the electron guns.

Color cathode ray tubes have received a great deal of attention as high-quality broadcast image display devices or computer terminal high-resolution graphic display devices. For these applications, increased resolution has been an issue. High resolution in a color cathode ray tube can be achieved by minimizing an electron beam spot on its phosphor screen. However, in order to minimize the electron beam spot, the electrode structure of the electron gun assembly must be improved, or the electron gun assembly itself must be elongated and enlarged to increase its diameter. However, large electron gun assemblies cannot provide a sufficiently small electron beam spot for the following reason. The larger the size of the color cathode ray tube becomes, the longer the distance between the electron gun assembly and the phosphor screen becomes. In addition, the electron lens thereof has an undesirable large magnification. In order to achieve high resolution of a large cathode ray tube, it is important to decrease the distance between the electron gun assembly and the phosphor screen. For this purpose, the tube can be constituted by a wide-angle deflection tube. However, in such a tube, the magnification at the central portion of the screen differs from that at the peripheral portions thereof.

In order to solve the above problem, Japanese Patent Disclosure (Kokai) No. 48-90428 describes a multi-tube structure display device having a plurality of small or medium size cathode ray tubes, arrayed in the horizontal or vertical direction to display an image on a large screen with high resolution.

A conventional display device of the multi-tube structure can be effectively used outdoors to display an image on a very large screen divided into blocks. However, the display device is not suitable for a medium size screen, i.e., about 40", since the joints of the divided blocks of the screen stand out, presenting a poor image. In particular, when this device is used as a computer-aided design graphic display terminal, the presence of joints becomes a decisive shortcoming.

SUMMARY OF THE INVENTION

It is an object of the present invention to provide a high-resolution color cathode ray tube.

In order to achieve the above object of the present invention, there is provided a color cathode ray tube comprising:

a vacuum envelope including a panel having a single faceplate and a skirt extending from the faceplate, a plurality of funnels coupled to the panel, and a plurality of necks respectively extending from the plurality of funnels;

a plurality of electron gun assemblies respectively accommodated in the plurality of necks and having central axes, the plurality of electron gun assemblies each being adapted to emit a plurality of electron beams;

a plurality of deflection units, respectively mounted around the plurality of funnels, each of the deflection units deflecting the electron beams emitted from the corresponding electron gun assembly in a deflection plane defined by each of the deflection units;

a shadow mask received in the envelope and faced to the faceplate and having apertures of predetermined pitch Ph for allowing passage of deflected electron beams therethrough; and a screen formed on an inner surface of the faceplate and including phosphor elements on which the deflected electron beams passing through the apertures land and which emit light rays of different colors, the screen being defined by a plurality of continuous segment regions each of which is scanned with the electron beams emitted from the corresponding electron gun assembly and deflected by the corresponding deflection unit, wherein the electron gun assemblies adjacent each other are so arranged as to have a relative distance GS between the central axes thereof:

$$GS = m \cdot SG[(n-1)Ph + d]/Ph$$

where SG is a relative distance on the deflection plane between the electron beams emitted from each of the electron gun assembly, d is a distance between predetermined effective apertures of the shadow mask through which the predetermined electron beams pass, the predetermined electron beams landing on endmost adjacent effective phosphor elements in each two adjacent ones of the segment regions, and m and n are integers, respectively.

DETAILED DESCRIPTION OF THE PREFERRED EMBODIMENT

Figure 1:
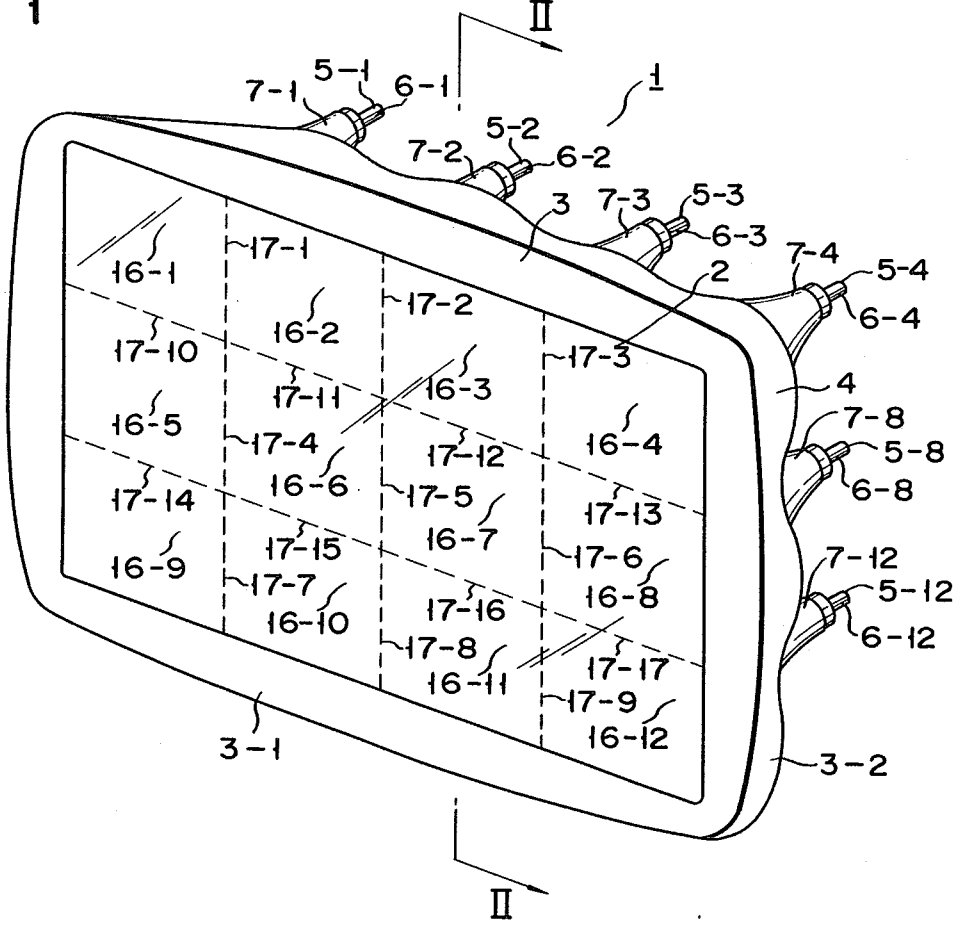
FIG. 1 is a perspective view showing a color cathode ray tube having a multineck structure according to an embodiment of the present invention.
Figure 2:
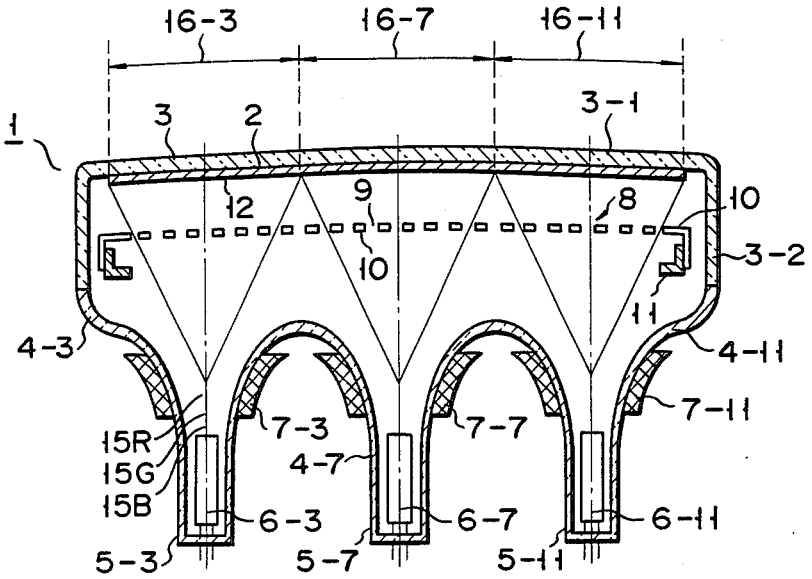
FIG. 2 is a sectional view along II—II line in FIG. 1.

Referring to FIGS. 1 and 2, color cathode ray tube 1 having a multineck structure according to an embodiment of the present invention is illustrated. In tube 1, phosphor screen 2 is formed on the inner surface of faceplate 3-1 of panel 3. A plurality of necks 5-1, . . . 5-12 are hermetically coupled to skirt 3-2 of panel 3, extending from the edge of faceplate 3-1 through a plurality of funnels 4-1, . . . 4-12 to constitute a vacuum envelope. Screen 2 includes a large number of phosphor groups, each consisting of red, green, and blue phosphor stripe layers 12. Layers 12 are covered with a metallized layer. Electron gun assemblies, such as inline or delta type assemblies 6-1, . . . 6-12, each having a elctron gun unit for emitting three different electron beams toward the screen, are respectively accommodated in necks 5-1, . . . 5-12. Assemblies 6-1 to 6-12 have parallel central axes which are separated by distance GS (to be described later). A plurality of deflection yokes 7-1, . . . 7-12 are respectively mounted on the outer surfaces of funnels 4-1, . . . 4-12 to deflect the electron beams emitted from assemblies 6-1, . . . 6-12. Mask unit 8, including a shadow mask 10 located opposite screen 2 at a predetermined distance therefrom and having a plurality of apertures 9 and a frame 11 for supporting mask 10, is mounted on the inner surface of skirt 3-2 of panel 3 by a support structure (not shown).

The three electron gun units in each of the assemblies 6-1, . . . 6-12 respectively emit electron beams 15-R, 15-G, and 15-B in response to corresponding video signal components. Beams 15-R, 15-G, and 15-B are deflected by corresponding yokes 7-1, . . . 7-12. Segment regions 16-1, . . . 16-12 of screen 2, which correspond to assemblies 6-1, . . . 6-12, are scanned with the respective sets of deflected beams 15-R, 15-G, and 15-B. Beams 15-R, 15-G, and 15-B are incident on mask 10 at predetermined angles and are selected according to the incident angles. Beams 15-R, 15-G, and 15-B then land on corresponding phosphor stripe layers 12 of the screen and cause emission thereof. Single screen 2 is thus defined as a set of continuous segment regions 16-1, . . . 16-12 respectively corresponding to assemblies 6-1, . . . 6-12. As shown in FIGS. 1 and 2, three segment regions are aligned in the vertical direction and four segment regions are aligned in the horizontal direction to constitute a total of 12 segment regions 16-1, . . . 16-12 in a matrix form.

Regions 16-1, . . . 16-12 are continuously formed to keep continuity of the image and to eliminate poor image recognition. Portions 17-1, . . . 17-17 are constituted as overlapping sections of adjacent ones of regions 16-1, . . . 16-12. Even if regions 16-1, . . . 16-12 partially overlap to constitute portions 17-1, . . . 17-17, different color phosphors are mixed in or white balance is impaired at the overlapping portions of pitches different to those of the adjacent segment regions. In order to give natural continuity to the phosphor stripes in the adjacent segment regions, assemblies 5-1, . . . 5-12 are arranged to have predetermined intervals therebetween, as follows.

Figure 3:
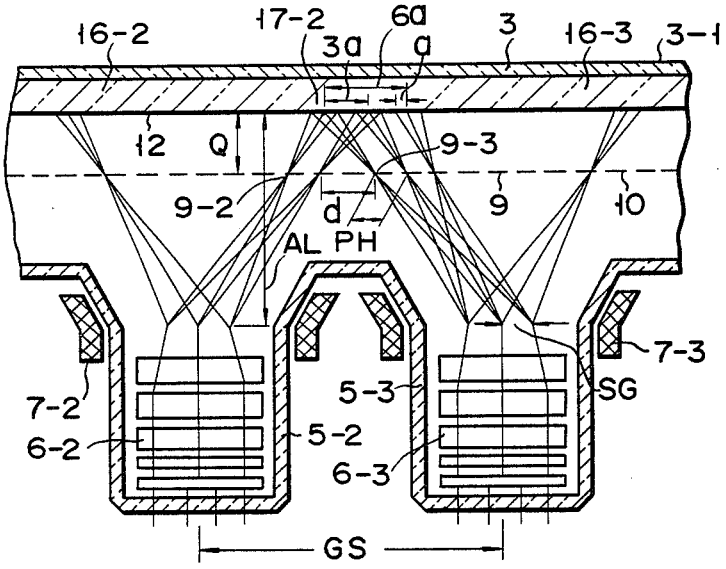
FIG. 3 is a sectional view showing part of the tube in FIG. 1 for explaining the positional relationship between electron gun assemblies.

Assume that given two adjacent ones of regions 16-1, . . . 16-12 are scanned with electron beams from two corresponding assemblies 6-1, . . . 6-12, and that adjacent portions 17-1, . . . 17-17 are scanned with electron beams from the corresponding electron gun assemblies. Each portion 17-1, . . . or 17-17 of regions 16-1, . . . 16-12 has a width of $6\sigma$. For example, as shown in FIG. 3, portion 17-1 between adjacent regions 16-2 and 16-3 has a width of $6\sigma$. Width $\sigma$ corresponds to an interval between adjacent red, green and blue phosphor stripes. Width $3\sigma$ corresponds to an interval between adjacent groups of the red, green and blue phosphor stripes within one of two regions 16-2 and 16-3. Width $6\sigma$ is the sum of intervals between groups of the red, green and blue phosphor stripes in two regions 16-2 and 16-3. Two sets of three beams from assemblies 6-2 and 6-3 are deflected within the deflection planes of yokes 7-2 and 7-3, as shown in FIG. 3. In practice, the electron beams are gradually deflected by the magnetic fields of yokes 7-2 and 7-3. The planes of deflection and distances SG between electron beams within each of the deflection planes are gradually changed during deflection. A ratio of distance AL, between the deflection plane and the phosphor screen 2, to distance Q, between screen 2 and mask 10, is given as follows:

$$AL/Q = GS/(Ph+d) \tag{1}$$

where GS is the distance between the adjacent electron gun assemblies, Ph is the pitch of the shadow mask, and d is the distance between predetermined effective apertures 9-2 and 9-3 of mask 10 at portion 17-2. The predetermined effective apertures (i.e., 9-2 and 9-3) are defined by the predetermined electron beams emitted from assemblies 6-2 and 6-3 passing through the predetermined effective apertures and landing on phosphor stripes corresponding to the edge of portion 17-2 having a width of $6\sigma$.

The ratio of distance AL, between the deffection planes of assemblies 6-2 and 6-3 and screen 2, to distance Q, between screen 2 and mask 10, is expressed as follows:

$$AL/Q = 3SG/Ph \tag{2}$$

where SG is the distance between electron beams on the deflection planes denifed by yokes 7-1 and 7-12, and Ph is the pitch of the shadow mask. Equations (1) and (2) yield distance GS as follows:

$$\begin{aligned} GS &= (AL/Q) \times (Ph + d) \\ &= (3SG/Ph) \times (Ph + d) \end{aligned} \tag{3}$$

In the embodiment shown in FIG. 3, each overlapping portion has a width of $6\sigma$, i.e., two screen pitches. An overlapping portion width of n screen pitches (n=0, 1, 2, 3, . . . ) will be taken into consideration below. A ratio of distance AL between the deflection planes of assemblies 6-2 and 6-3 and the screen 2 to distance Q between screen 2 and mask 10 is given:

$$AL/Q = GS/[(n-1)Ph+d] \tag{4}$$

where GS is the distance between assemblies 6-2 and 6-3, and Ph is the pitch of the apertures in mask 10 through which the electron beams to land on portion 17-2 pass. When a width of portion 17-2 is given as n screen pitch $3n\sigma$ according to equations (2) and (4), the distance between the assemblies is:

$$\begin{aligned} GS &= (AL/Q)[(n-1)Ph + d] \\ &= (3SG/Ph)[(n-1)Ph + d] \end{aligned} \tag{5}$$

Thus, when assemblies 6-1, . . . 6-12 are arranged to satisfy equation (5), screen 2 can display an image of natural continuity.

Figure 4:
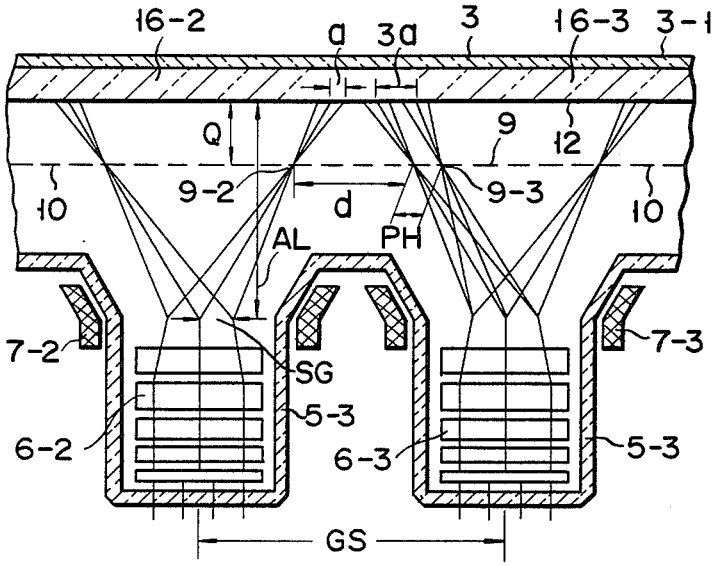
FIGS. 4 and 5 are respectively sectional views showing parts of cathode ray tubes of a multineck structure for explaining positional relationships between electron gun assemblies in a color cathode ray tube according to another embodiment of the present invention.

FIG. 4 shows another embodiment of the present invention. According to this embodiment, overlapping portions 17-1, . . . 17-17 are not formed between adjacent segment regions 16-1, . . . 16-12, but a naturally continuous image can still be displayed on screen 2. In this case, a screen pitch is n=0. Distance GS between the adjacent electron gun assemblies is:

$$\begin{aligned} GS &= (AL/Q)[d - Ph] \\ &= (3SG/Ph)(d - Ph) \end{aligned} \tag{6}$$

Figure 5:
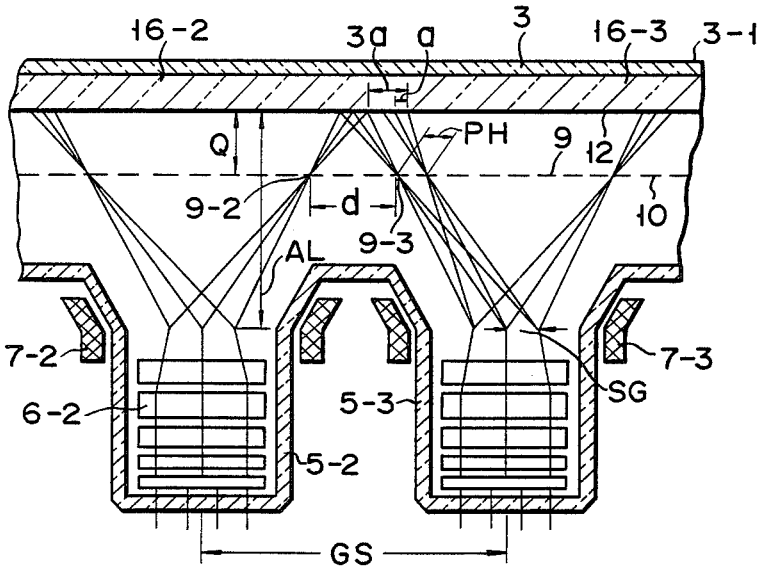

As shown in FIG. 5, when overlapping portions 17-1, . . . 17-17, each having a width of one stripe pitch, i.e., $3\sigma$ between adjacent segment regions 16-1, . . . 16-12, a screen pitch is n=1. Distance GS between the adjacent electron gun assemblies is:

$$GS = (AL/Q)d \quad (7)$$
$$= (3SG/Ph)d$$

The same reference numerals in FIGS. 4 and 5 denote the same parts as in FIGS. 1 and 2.

In the above description, three electron beams emitted from each electron gun assembly are deflected. However, the above relation can be applied to the another, electron gun system in which a single electron beam emitted from an electron gun unit is subjected to slight deflections to obtain three electron beams before the single beam reaches the deflection plane and the three beams are deflected in the deflection planes, as descrilbed in a U.S. application relating to the Takenaka et al, filed in Apr. 18, 1986 and assigned to the same assignee. If at least two electron beams are deflected in each deflection plane, a ratio of distance AL, between the deflection planes of the electron gun assembly and the phosphor screen, to distance GS, between adjacent electron beams on each deflection plane, is given by:

$$AL/Q = l \times SG/Ph \quad (8)$$

where l is the number of electron beams, and SG is the distance between the electron beams on each plane of deflection. Distance GS between the electron gun assemblies is:

$$GS = (AL/Q)(n-1)Ph + d \quad (9)$$
$$= (l \times SG/Ph) \times [(n-1)Ph + d]$$

where n is the screen pitch number in the overlapping portion, and d is the distance between the effective apertures of the shadow mask.

In the above embodiments, screen 2 has a size of 658 mm (horizontal direction) 493.5 mm (vertical direction), and is divided into, for example, twelve square segment regions, each having a side of 164.5 mm. Each of overlapping portions has a width of $6\sigma$. In order to improve workability of the shadow mask, shadow mask pitch Ph is uniform. For this reason, distance d in the noneffective shadow mask portion must be an m multiple of pitch Ph. Distance GS between assemblies is thus:

$$GS = (3SG/Ph) \times (Ph + mPh)$$
$$= 3(m+1)SG$$

Distance GS between the electron gun assemblies is an integer multiple of three times distance SG between the electron beams on each plane of deflection. Distance SG is 3.5 mm. If m=46, then GS=164.5. Distance AL between the deflection plane and the phosphor screen is 117 mm, and the shadow mask pitch is 0.60 mm. Distance Q between the phosphor screen and the shadow mask is 6.7 mm, and thus screen pitch $3\sigma$ must be 0.64 in accordance with the equation described above. As stated previously, the phosphor layer is of a stripe type. It is thus apparent that the vertical location of the electron gun assembly need not satisfy the above equation. Even if the phosphor screen is of a dot type, the positional relationship between the electron gun assemblies in a vertical and horizontal directions should be satisty the above described relation description. In the above embodiments, each electron gun assembly is of an inline type. However, the electron gun assembly may be a delta type three-gun assembly. Although in the aforementioned embodiment a number of gun assemblies have been explained as being parallele in their axes, this invention can also apply to a CRT having a plurality of gun assemblies whose axes are not parallel to each other. That is, when the faceplate has a given inner surface curvature, the vertical axes of segment regions 16-1 . . . 16-12 are not parallel to each other. Since the axes of the electron gun assemblies are located in alignment with the axes of the segments, the axes of the electron gun assemblies are not parallel with each other. Stated in more detail, with the center electron gun assembley as a reference, the axes of the peripheral gun assemblies are individually inclined at an angle of, for example, 5° at max relative to the center electron gun assembly. In this case, therefore, a distance GS between the respective electron gun assemblies is determined as a distance between intersections defined between the deflection plane and the axis of the respective gun assembly.

According to the present invention as described above, problems posed by the conventional divided-display type cathode ray tube can be solved by obtaining a single phosphor screen and optimally arranging the electron gun assemblies. The image quality can thereby be improved to match that of cathode ray tubes of general type. The present invention can also be used for larger cathode ray tubes.

What is claimed is:

1. A color cathode ray tube comprising:

a vacuum envelope including a single faceplate, a panel having a skirt extending from said faceplate, a plurality of funnels coupled to said panel, and a plurality of necks respectively extending from said plurality of funnels;

a plurality of electron gun assemblies respectively accommodated in said plurality of necks and having central axes, said plurality of electron gun assemblies each being adapted to emit a plurality of electron beams;

a plurality of deflection units, respectively mounted around said plurality of funnels, each of said deflection units deflecting the electron beams emitted from said corresponding electron gun assembly in a deflection plane defined by each of said deflection units;

a shadow mask received in said envelope and faced to said faceplate and having apertures of predetermined pitch Ph for allowing passage of deflected electron beams therethrough; and a screen formed on an inner surface of said faceplate and including phosphor elements on which the deflected electron beams passing through said apertures land and which emit light rays of different colors, said screen being defined by a plurality of continuous segment regions each of which is scanned with the electron beams emitted from said corresponding electron gun assembly and deflected by said corresponding deflection unit wherein said electron gun assemblies adjacent each other are so arranged as to have a relative distance GS between the central axes thereof:

$$GS = m \cdot SG[(n-1)Ph + d]/Ph$$

where SG is a relative distance on the deflection plane, between the electron beams emitted from each of said electron gun assemblies, d is a distance between predetermined effective apertures of the shadow mask through which the predetermined electron beams pass, the predetermined electron beams landing on endmost adjacent effective phosphor elements in each two adjacent ones of said segment regions, and m and n are integers, respectively.

2. A tube according to claim 1, wherein said electron gun assemblies are parallel to each other.

3. A tube according to claim 1, wherein said adjacent segment regions have an overlapping portion therebetween.

4. A tube according to claim 1, wherein said electron gun assemblies emit three electron beams each and are located at positions to have distance GS between the central axes given by:

$$GS=3SG[(n-1)Ph+d]/Ph.$$

5. A color cathode ray tube according to claim 1, wherein said electron gun assemblies are nonparallel to each other.

6. A color cathode ray tube according to claim 1, wherein the distance GS is defined as a distance between cross points between the central axes of the electron gun assemblies in the deflection plane.

7. A tube according to claim 1 wherein the electron gun assemblies may continuously scan the screen without any boundaries.

* * * * *